United States Patent [19]

Zalesak et al.

[11] 4,181,001

[45] Jan. 1, 1980

[54] CROSS WEDGE ROLLING APPARATUS

[75] Inventors: Jan Zálešák, Modrice; Miloslav Bednar, Brno, both of Czechoslovakia

[73] Assignee: Vyzkumny ustav tvarecich stroju a technologie tvareni, Brno, Czechoslovakia

[21] Appl. No.: 891,916

[22] Filed: Mar. 30, 1978

[51] Int. Cl.[2] ..... B21H 8/02

[52] U.S. Cl. ..... 72/108; 72/102

[58] Field of Search ..... 72/102, 107, 108, 109

[56] References Cited

U.S. PATENT DOCUMENTS

| | | | |
|---|---|---|---|
| 50,458 | 10/1865 | Cooper | 72/108 |
| 260,196 | 6/1882 | Hastings | 72/108 |
| 470,354 | 3/1892 | Slick | 72/108 |
| 2,686,442 | 8/1954 | Wilson | 72/107 |

*Primary Examiner*—Lowell A. Larson

[57] ABSTRACT

Apparatus for the cross wedge rolling of parts of bodies of revolution of reduced diameter, the apparatus including a tool having the shape of a cam, the active surfaces of which are parts of the surface of a body of revolution the axis of which is eccentric with respect to the axis of rotation of the tool, the tool having a calibration part advantageously following the reducing part of the tool.

1 Claim, 5 Drawing Figures

CROSS WEDGE ROLLING APPARATUS

BACKGROUND OF THE INVENTION

The expression "cross wedge rolling" relates to a rolling process wherein opposed rolling tools rotate around axes parallel with the axis of the object being rolled, the rolling tool proper usually having the shape of a wedge or of a disc. The material of which the object being rolled is usually metal.

The invention relates to the cross rolling of bodies of revolution, and its object is to form parts of reduced diameter. The section passing through the axis of the body has substantially the shape of a trapezoid, the smaller base of which (i.e. the width of the shorter base on the smallest diameter) is at a maximum 130% of the diameter of the body of revolution.

Similar portions of reduced diameter are actually manufactured by cross rolling by means of wedge shaped tools, i.e. by cross wedge rolling, the principal drawback of such method being the high costs of the tools.

SUMMARY OF THE INVENTION

It is an object of this invention to eliminate or at least substantially mitigate this drawback and to provide a tool which is efficient and of lower price. According to this invention, the tool has the shape of a cam with a front reducing surface, and with two inclined lateral reducing surfaces. Advantageously, calibrating surfaces are provided behind the reducing surfaces.

DESCRIPTION OF THE DRAWING

A examplary embodiment of the apparatus of this invention is shown on the attached drawings, wherein.

DESCRIPTION OF PREFERRED EMBODIMENT

Figure 1:
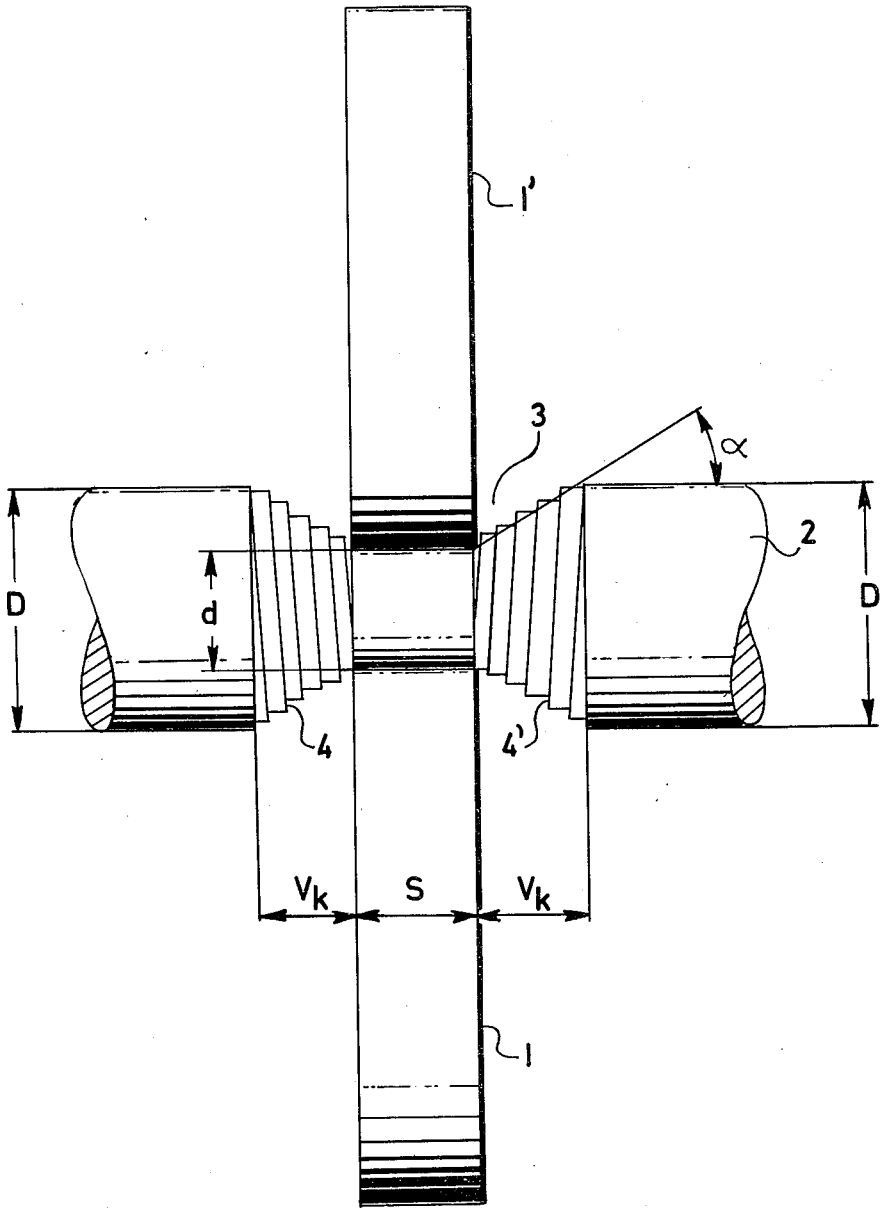
FIG. 1 is a diagrammatic elevation, illustrating the progress of displacement of the material by rolling.

Before describing the apparatus of the invention, it will be helpful to consider cross rolling and its effect in general. FIG. 1 illustrates the progress of displacement of material in the course of cross rolling by means of two narrow circular cylindrical discs 1, 1', which are gradually brought closer together in the course of rolling thereby entering into the material 2 and forming lateral surfaces 4, 4' at the restricted portion 3. If the rate of approach of the discs toward each other is sufficiently slow with respect to their speed of rotation, the lateral surfaces 4, 4' will show hardly any visible helical traces, which are emphasized for clarity in FIG. 1. The surfaces 4, 4' can be considered to be conical surfaces and if we use an equation determining equal volumes, we obtain:

$$\pi\left(\frac{D}{2}\right)^2 \cdot S \doteq \tag{1}$$

-continued $$\pi\left(\frac{d}{2}\right)^2 \cdot S + 2\frac{1}{3}\pi V_k\left[\left(\frac{D}{2}\right)^2 + \frac{D}{2}\cdot\frac{d}{2} + \left(\frac{d}{2}\right)^2\right]$$

from which equation we can calculate the value $V_k$. In the above equation:

D is the original diameter of the body, d is the diameter of the restricted part, $V_k$ is the width of the conical surface between the original and restricted part, and S is the width of the part restricted to the diameter d.

($\doteq$ means approximately equal.)

The following equation is also valid for FIG. 1:

$$V_k \doteq \frac{\frac{D}{2} - \frac{d}{2}}{\alpha} \tag{2}$$

where $\alpha$ is the angle of the conical surface measured from the axis of the body.

From equations (1) and (2) it follows that:

$$\alpha \doteq \frac{\frac{1}{3}(D^2 + dD + d^2)}{S(D + d)} \tag{3}$$

Figure 2:
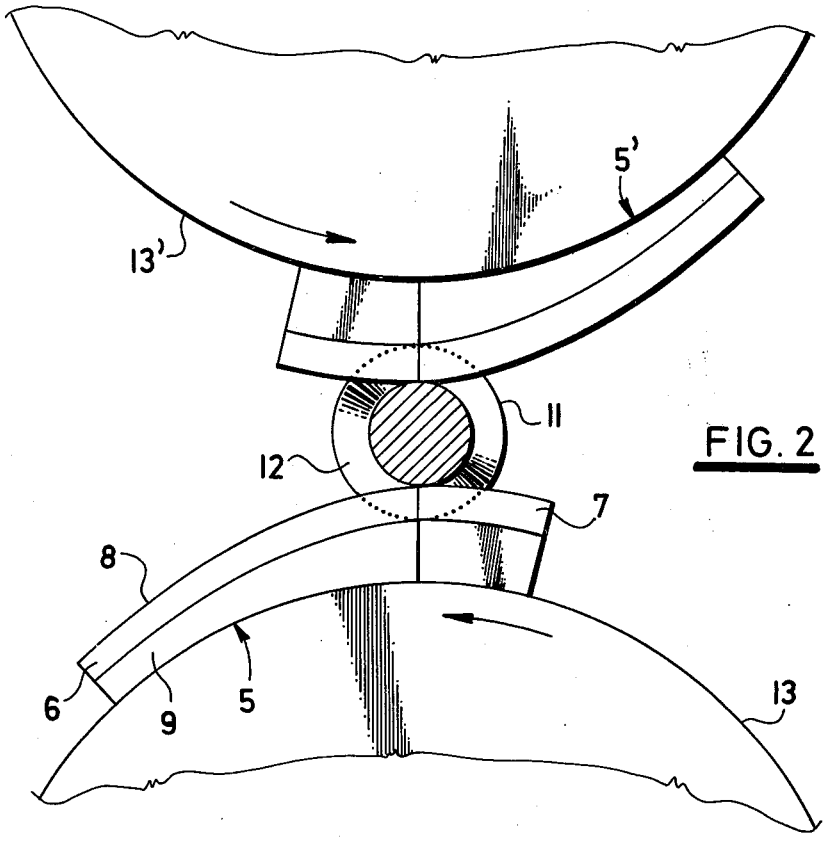
FIG. 2 is a diagrammatic side view showing a pair of similar opposed tools according to this invention.
Figure 3:
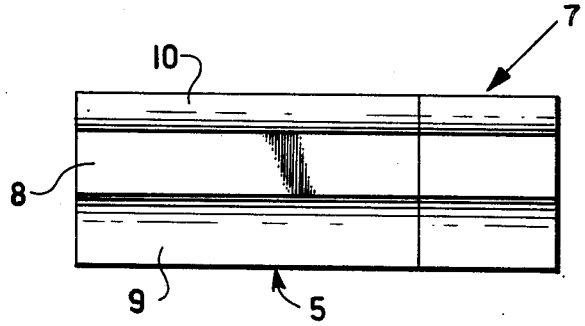
FIG. 3 is a top view of one such tool.
Figure 4:
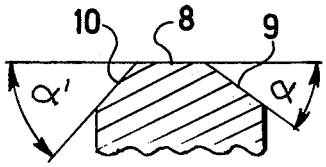
FIG. 4 is a sectional view of the tool, the section taken along a plane indicated in FIG. 2 by the line A—A.

Each of similar rolls 13, 13' according to this invention, as shown in FIGS. 2, 3 and 4 has a respective tool or working member 5, 5' thereon. It is necessary to describe only tool 5 in detail. Tool 5 has lateral reduction surfaces 9, 10, which produce pressure on the lateral surfaces of the generated restricted portion 12 of the workpiece, so that their angle with respect to the axis of the rolled body 11 must not be larger than the angle $\alpha$ determined approximately by equation (3) when the lateral surfaces of the restricted portion 3 are conical. It is possible to determine more accurately the conditions for the inclination of the reduction surfaces 9, 10 by differential and integral calculation, which starts from very small subsequent displacements of material. This may also be done in cases where the lateral surfaces of the portions 12 have shaped other than conical surfaces.

The tool 5 as shown in FIGS. 2 and 3 comprises a reduction part 6 and a calibration part 7, both the reduction part 6 and calibration part 7 being parts of an integral single body; however, parts can be independent. As above explained, the tools 5, 5' fixed to working rolls 13, 13', respectively are of the same shape, and the working rolls 13, 13' rotate around their fixed and mutually parallel axes in the same direction. The reduction part 6 of the tool 5 has a generally central reduction surface 8 and lateral reduction surfaces 9, 10, surfaces 9, 10 being disposed at angles $\alpha$, $\alpha'$ with respect to the axis of the rolled body. All reduction surfaces are parts of surfaces of bodies of revolution, their shapes correspond in cross section along their whole length to the negative or reverse of the worked part to be made. The radius of the reduction part 6 is on its start smaller than on its trailing end in order gradually to form the restriction. The reduction part 6 is fixed to its supporting working roll 13 so that the axis of the body of revolution, of which the reduction surfaces 9 form a part, is eccentric with respect to the axis of the supporting working roll 13, thus permitting their easy manufacture.

The calibration part 7 has a constant height along its whole length and its cross section corresponds to the negative or reverse of the reduction part of the rolled body to be made.

Figure 5:
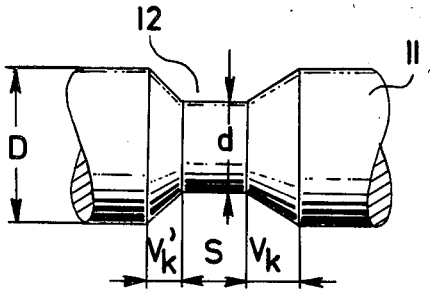
FIG. 5 is a fragmentary view in elevation showing the shape of the restricted portion of a workpiece produced by rolling with apparatus according to the invention.

As is apparent from the above and from FIGS. 2–4, inclusive, of the drawings, the rolled parts have a central portion 12 of reduced diameter and lateral portions one of which is designated 12 of larger diameter extending from the respective ends of the central portion of reduced diameter. The central portion 12 is of broad V-shape with a cylindrical base and oppositely inclined sides (FIGS. 3 and 5). Each of the tools has an axially central workpiece reducing cam surface 8 and cam reducing surfaces 9 and 10 (FIGS. 3 and 4) extending laterally beyond the respective ends of the central reducing cam surface 8. The central reducing cam surface 9 and the lateral cam reducing surfaces extend along the entire axial length of the tool. The lateral reducing surfaces form with axis of rotation of the tool angles the value of which depends upon the reduced diameter d of the base of the broad V-shaped central reduced portion of the workpiece, the initial diameter D of the workpiece, and the width $V_k$ of each of the inclined side surfaces of the broad V-shaped reduced central portion of the rolled workpiece.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. Apparatus for cross wedge rolling parts of reduced diameter from workpieces in the form of bodies of revolution, the rolled parts having a central portion of reduced diameter and lateral portions of larger diameter extending from the respective ends of the central portion of reduced diameter being of broad V shape with a cylindrical base and oppositely inclined side surfaces, said apparatus comprising two opposed working rolls adapted for rotation in the same direction about parallel axis, a tool on each of said working rolls, each tool having an axially central workpiece reducing cam surface and cam reducing surfaces extending laterally beyond the respective ends of the central reducing cam surface, said central reducing cam surface and lateral cam reducing surfaces extending along the entire axial length of the tool, said lateral reducing surfaces forming with the axis of rotation of the tool angles the value of which depends upon the diameter d of the base of the broad V-shaped central reduced portion of the rolled workpiece, the initial diameter D of the workpiece, and the value $V_k$, $V_k$ and $\alpha$ responding to the formulae:

$$V_k \doteq \frac{\frac{D}{2} - \frac{d}{2}}{\alpha}$$

and $$\alpha \doteq \frac{\frac{1}{3}(D^2 + dD + d^2)}{S(D + d)},$$

where $\alpha$ is the angle of the inclined side surfaces at the ends of the broad V-shaped central reduced diameter portion of the rolled workpiece, said angle being measured with respect to the axis of the workpiece, D is the original diameter of the body, d is the diameter of the base of the broad V-shaped central reduced portion of the rolled workpiece, $V_k$ is the width of each of the inclined side surfaces of the broad V-shaped reduced central portion of the rolled workpiece, S is the width of the base of the broad V-shaped central portion of the rolled workpiece, ($\doteq$ means approximately equal).

* * * * *